United States Patent [19]

Fratta

[11] Patent Number: 4,517,864

[45] Date of Patent: May 21, 1985

[54] CYLINDRICAL PIN WRENCH

[76] Inventor: Peter J. Fratta, 11904 Crown Dr., Dunkirk, Md. 20754

[21] Appl. No.: 525,243

[22] Filed: Aug. 22, 1983

[51] Int. Cl.[3] ..... B25B 15/00

[52] U.S. Cl. ..... 81/436; 81/44; 81/52; 81/438

[58] Field of Search ..... 81/3 R, 53 R, 436, 438; 145/46

[56] References Cited

U.S. PATENT DOCUMENTS

| | | | |
|---|---|---|---|
| 337,061 | 3/1886 | Higgins et al. | 145/46 |
| 1,392,728 | 10/1921 | Westman et al. | 81/436 |
| 1,618,889 | 2/1927 | Ruping | 145/46 |
| 2,544,492 | 3/1951 | Downing | 145/46 |
| 2,943,665 | 7/1960 | Cincel | 81/436 |
| 4,094,350 | 6/1978 | Jacobson | 81/436 |

FOREIGN PATENT DOCUMENTS

| | | | |
|---|---|---|---|
| 671087 | 4/1952 | United Kingdom | 81/436 |

*Primary Examiner*—Frederick R. Schmidt
*Assistant Examiner*—J. T. Zatarga
*Attorney, Agent, or Firm*—E. Barron Batchelder

[57] ABSTRACT

A wrench for a cylindrical pin and the like adapted for connective mounting to, supporting, handling, maneuvering and rotating the pin, the pin having a wrench engageable hole therethrough, the wrench including a frictionally operable curvilinear pin engaging recessed portion, an end operating handle portion, and a pin hole engaging end, the wrench, when engaged to the pin with the hole operatively interengaged, being operable for positionally, maneuverably and rotatably moving the pin.

11 Claims, 6 Drawing Figures

22
24
12
30
32
34
10
18
16
20
36
26
28
14

46

44
52
48
56
54
50

56
46
40
50
36
38
44
54
42
48
52

CYLINDRICAL PIN WRENCH

TECHNICAL FIELD

The invention relates broadly to a wrench of a particular configuration adapted for handling of cylindrical pins and the like in maneuvering and rotating the pin for coactive engagement with a second member. The wrench has a configuration adapted for a frictional connection to a cylindrical pin or the like. The wrench is of a dimension for snap fit resilient engagement with the cylindrical pin. The wrench as engaged to the cylindrical pin permits a handling or manipulation of the pin in varied directional movement and in restricted areas. The wrench also includes means so engageable with the cylindrical pin to permit and insure rotational movement thereof to permit, for example, screw threaded engagement with a second member.

More specifically, the wrench is adapted for operative engagement with and support of a male contact pin for screw threaded engagement in a conductor contact pressed on an electric cable and operatively inserted in an elbow-type loadbreak connector, primarily in URD installations.

Elbow-type loadbreak connectors are well-known in the art and used in many and varied specific installations. A conductor cable, with or without a cable adapter, has a conductor contact pressed thereon and the cable end is then placed within one arm of a loadbreak connector. The loadbreak connector has a second arm positioned at right angles to the first arm, both of which are hollow and formed of insulation material, the conductor contact having a threaded hole formed proximate its free end and adapted to be engaged with a male contact pin having a screw threaded end thereon. The male contact pin must be inserted into the second end of the elbow loadbreak connector and maneuvered into a position for interengagement of the threaded end thereon in the threaded conductor contact end. Operational space is limited and to appropriately effect interconnection of the two members in a secure or tightened manner, a wrench-type action to rotate or turn the male contact pin is required. Normally the male contact pin includes a hole diametrically therethrough, in a spaced relation from the threaded end of the pin, and adapted for interengagement with a member or end on the pin wrench to operatively so interconnect the wrench and pin as to permit the desired rotation of the pin. This rotation of the pin in an insured manner permits the tight screw threaded interengagement of the male contact pin in the conductor contact on the end of the cable in the elbow loadbreak connector. Normally, the free end of the male contact pin has, as an integrated part therewith, an insulator section or segment.

Following installation of the above unit into the loadbreak connector, the loadbreak connector is operatively connected in a known manner with a power transformer, transclosure, tap hole on a pad mount or the like. In effecting this interconnection, the protective or insulated tip portion or segment on the male contact pin is inserted into the appropriate connection member and, after longitudinal movement of the elbow loadbreak connector a sufficient amount corresponding to the length of the insulator portion, contact is made between the male contact pin, which as is normal, consists of a conductive metal, into operative interengagement with the member to which fitted.

In order to accomplish appropriate interconnection of the male contact pin with the conductor contact, a relatively nondisplaceable interengagement of the wrench with the male contact pin is required. The present cylindrical pin wrench incorporates features which meet these demands or requirements.

BACKGROUND OF THE INVENTION

Elbow-type loadbreak connectors are used in electric distribution systems in great numbers. The installer of components of the distribution system must install or use loadbreak connectors of different styles and in different UD cable distribution components. Appropriate and facile handling of and interconnection of a male contact pin in an elbow-type loadbreak connector requires a tool or instrument which permits the operator to positively control or handle movement of the pin for proper insertion into interengaging position with the contact end on the cable, and to thereafter operatively interengage the respective threaded portions of the members.

Tools or devices for the described purpose have heretofore been known and used. One known type consists of a wrench having a generally "L" configuration or a "U" shape with one leg being relatively short and interengageable in a hole in the connector pin and the other, longer leg, constituting a manipulating handle. In operation, the wrench which consists of bent rod-like material has the shorter leg inserted in the hole in the contact pin and the so interconnected wrench and pin are thereafter inserted and assembled in the loadbreak connector. This type of wrench, however, is subject to problems in use. It is difficult to position the pin with the "L" or "U" shaped key which is provided with elbow kits since it has a tendency to slip out of the hole and operational engagement is lost.

Another type of wrench known in the art consists of a relatively expensive unit having a handle portion with a hole therein adapted for engagement over an end of the male contact pin, and the wrench further includes a pivotally mounted hole-engaging member which is spring-biased into a closed position, but so maneuverable as to permit placement of and interengagement of the end into the male contact pin hole. Units of this type, however, are not only expensive but are of substantial weight and size. Such a tool would normally be placed with a tool kit of the operator or installer and is subject to being misplaced or in a location not handy for the installer.

The present invention is primarily directed to a wrench of a type and configuration which will insure a positive interengagement with a male contact pin for maneuvering or handling thereof and which wrench is formed of rod or wire-like material so configured as to have a snap-on attachment to the contact pin. This wrench or key will be held positively in a fixed position with respect to a male contact pin when operatively interengaged. This serves to hold the wrench and pin in a fixed position, greatly simplifying the task of aligning and turning the pin for placement, removal and/or replacement. The wrench device is inexpensive and can be produced as a throw-away item. It is primarily devised to constitute a replacement for the key or wrench above-described which is normally supplied with an elbow loadbreak connector. The wrench of the present invention, accordingly, is devised to constitute a replacement for the key currently issued with such elbow kits.

As aforementioned, elbow-type loadbreak connectors are in widespread use and all include an elbow terminator or male contact pin. This pin must be installed in an arm of the loadbreak connector and positive control for maneuverability is necessary.

Heretofore, known types of wrenches or keys for manipulating the male contact pin have not been entirely satisfactory in use and/or are expensive in construction and subject to being non-readily available to an installer operator.

The wrench of the present invention is inexpensive to manufacture, is positive in action for holding and maneuvering a pin member such as a male contact pin in an elbow style loadbreak connector and is uncomplicated structurally and in operational use.

THE PRESENT INVENTION

It is, accordingly, a primary object of the present invention to provide a wrench for positive interconnection with and handling of cylindrical-shaped pins having operating holes therethrough, and particularly as adapted to male contact pins for operative interconnection with an elbow-type loadbreak connector.

The preferred construction is formed of a rod-like or wire material of substantial rigidity and is so configured as to have one end constituting an operating handle, a median portion is bent to form a curvilinear shaped recess to receive, in snap-fit and frictional interengagement, a cylindrical pin, and the opposite end is bent at an angle to the median portion and is adapted for insertion in a manipulating hole in a male contact pin. When the wrench is so operationally positioned and interconnected with the male contact pin, the installer has a positive and functional control of the connector pin, permitting insertion in the elbow connector and interengagement of the threads on the pin and the threaded hole in the conductor contact which is press-fitted on a cable end and inserted in an arm of the elbow.

The wrench of the present invention while being extremely suitable for use in connection with the handling and mounting of male contact pins in elbow style loadbreak connectors, obviously will be susceptible of additional uses involving the mounting, positionment, and handling of cylindrical elements or objects for manipulation thereof.

The wrench of the invention is relatively simple to manufacture and, being inexpensive, can be considered as being a throw-away or disposable item susceptible to being packaged with a loadbreak connector of the type referred to.

Other objects and advantages of the present invention will become readily apparent to those skilled in the art from the following detailed description, wherein there is shown and described a preferred embodiment of the invention, simply by way of illustration of a currently preferred and contemplated mode for carrying out the invention. As will be realized, the invention is susceptible to other and specific embodiments, and materials, and details are capable of modification in various, obvious respects, all without departing from the invention. Accordingly, the drawings and description are to be regarded merely as illustrative in nature, and not as restrictive.

DESCRIPTION OF A PREFERRED EMBODIMENT

Broadly and summarily, the invention resides in a wrench or tool for cylindrical pins, for connective mounting, supporting, handling, maneuvering, and rotating a threaded end pin having a diametrical hole therethrough, for threadedly engaging and tightening the pin in a member having a threaded connection hole therein, the wrench including a pin supporting and attaching median section with a curvilinear recess adapted for frictional engagement with a peripheral surface portion of the pin, an end operating handle portion disposed at an angle to the median portion and a pin connection hole engaging end disposed at an angle to the median portion, the wrench, when engaged to the pin and with the connecting hole operatively interengaged by the end portion being positionally maneuverable and rotatable by turning of the handle portion to operatively engage and secure the pin and the member or disengage the pin from the member.

More particularly, the wrench of the present invention is adapted for operative insertion of an elbow loadbreak connector male contact pin into screw threaded engagement with a conductor contact pressed on an electric distribution cable and inserted into the loadbreak connector. The male contact pin in addition to having a threaded end thereon has a diametrical wrench engaging hole therethrough and at the free end includes a protective tip portion in the nature of non-conductive material. The elbow connector, as is well known, includes two arms disposed at right angles to one another, the cable and conductor contact pressed thereon are introduced into one arm and the male contact pin then is placed into the other arm by means of the wrench of the present invention, the interengageable screw threads being utilized to connect the two members aided and facilitated by the wrench of the present invention.

Referring now in detail to the drawings, even though the present invention is more broadly applicable than as applied to the elbow loadbreak connector specifically shown, it is principally adapted for use therewith.

Figure 1:
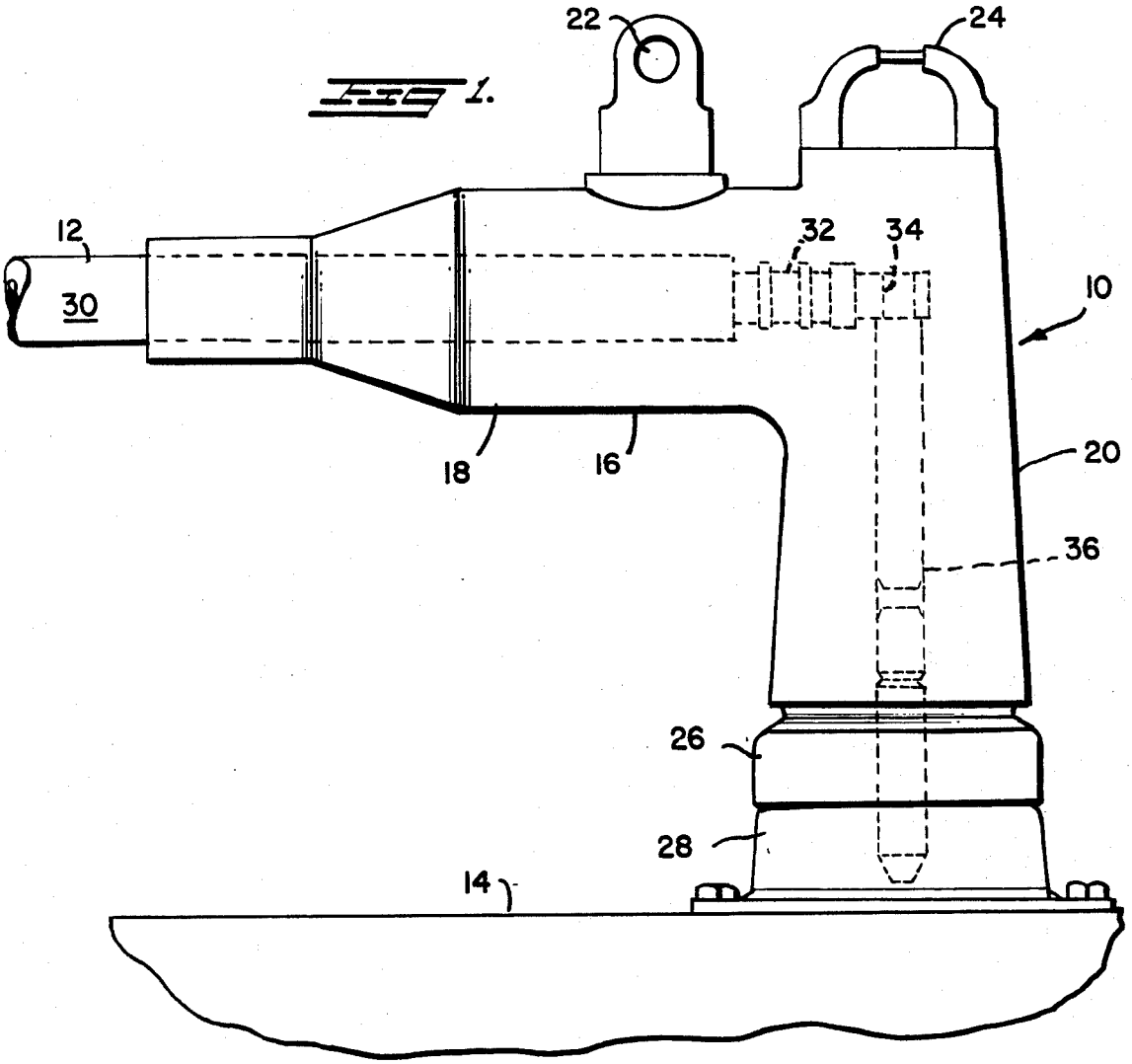
FIG. 1 is a fragmentary side elevational view of an elbow style loadbreak connector, a conductor cable, the end thereof having a press-fitted connector end and an interengaged and installed male contact pin being shown in dotted lines in an operational installation therein.
Figure 4:
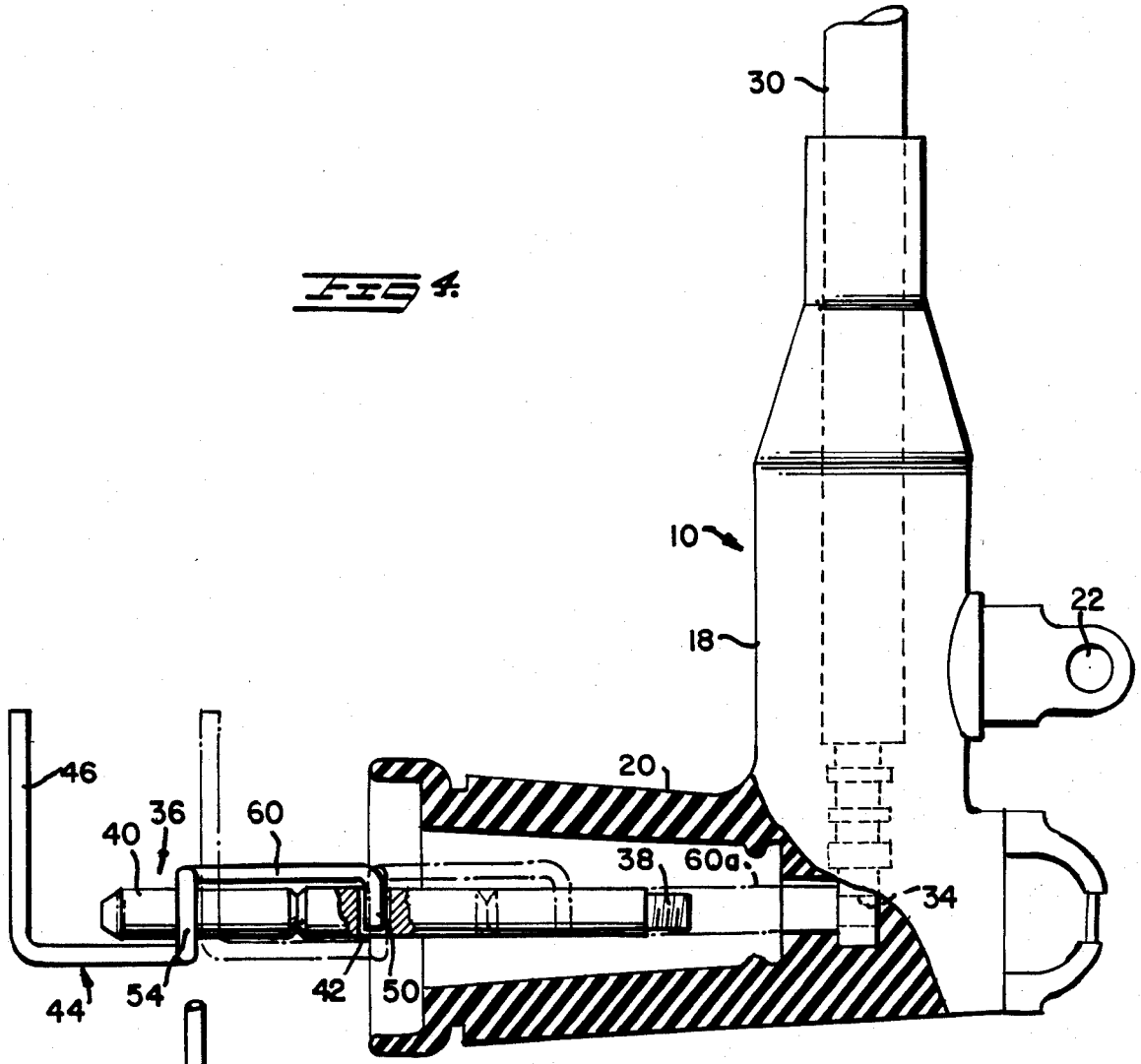
FIG. 4 is a side elevational view of an elbow-type loadbreak connector, portions being broken away for clarity of disclosure, and disclosing the insertion therein of a male contact pin together with an attached handling wrench of the present invention, different operational positions of the wrench and pin being shown in full and broken lines.

In FIGS. 1 and 4, an elbow loadbreak connector is generally shown and designated at 10. Devices of this nature are adapted for use primarily in UD and URD electrical systems. The elbow connector interengages an electric conducting cable 12, through the medium of the elbow loadbreak connector to a transformer such as generally indicated at 14. These loadbreak connectors are used not only on transformers, but also transclosures which are similar to a transformer, but only has a fuse therein and is strictly for fusing for protection, and additionally is usable in connection with feed through tap holes, etc. In some installations, they are connected to pad mounts outside, in conjunction with tap hole use. Existing URD laws now govern the type of bushings and connections for all underground work and, therefore, the loadbreak connectors are in widespread and multiple use.

The connectors 10 include an outer casing 16 which consists of arms 18 and 20 disposed at right angles to one another. The casing is constructed of insulative material such as rubber, plastics and the like, well known in the trade. A grounding eye 22 is affixed on arm 18 and a manipulating attachment 24 is disposed at an end of arm 20 adapted for use with a "hot stick" or the like to protect the operator in a known manner. The lower end of arm 20 has mounted thereto a rubber sealing sleeve 26 which in use prevents water or moisture from entering the unit to which attached. The transformer or the like has a connecting mount as generally indicated at 28 and which normally includes a female connective member, not shown, the function of which will be explained in greater detail hereinafter.

The cable 12 normally includes an extruded insulation shield 30. This shield prior to insertion into the connector is removed and a conductor contact, well known in the trade, and shown at 32 is pressed on a stripped and cleaned end of the cable which is then inserted inside the elbow as shown in FIG. 1. The conductor contact includes a threaded hole 34.

A male contact pin or terminal end pin 36 has a threaded end 38 adapted in assembled relationship in the connector for threaded interengagement in the threaded hole 34. This male contact pin, as will be obvious from FIGS. 1 and 4 of the drawings must be carefully and positively handled in order to position it within the arm 20 and to bring the threaded end 38 into interengagement with the threads of hole 34. The male contact pin 36 additionally has, at the free opposite end thereof, a protective tip portion 40 consisting of an electrical insulative material. This tip is adapted for placement and engagement within a female contact or bushing 28. The non-conductive portion or tip 40 is of such a length whereby insertion into a member such as transformer 14 takes it far enough so that contact is made between the male contact pin 36 consisting of a metal material and a metal contact within the transformer or the like.

Figure 2:
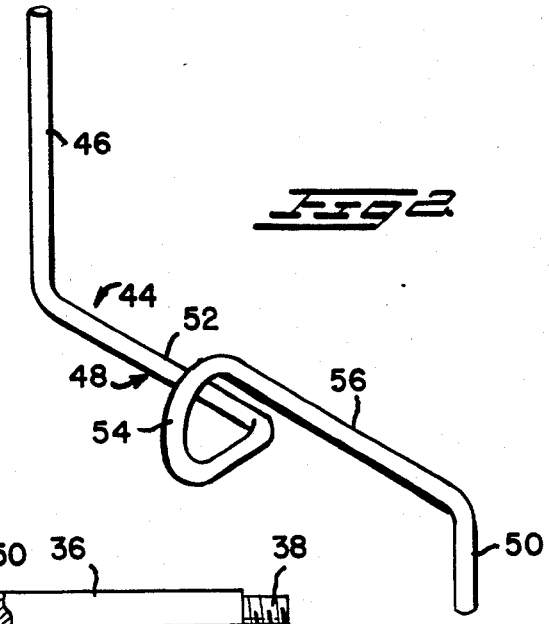
FIG. 2 is a perspective view of the tool or wrench of the present invention showing in detail the configuration thereof.
Figure 3:
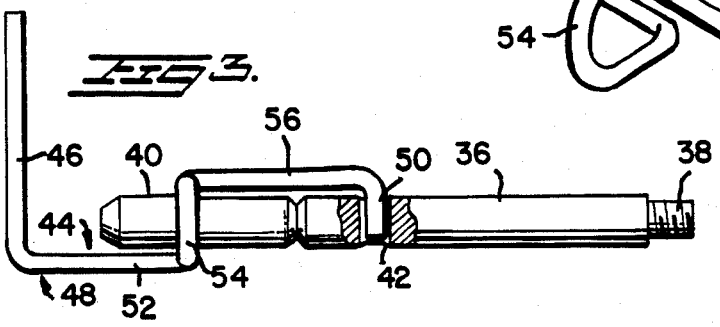
FIG. 3 is a side elevational view disclosing the wrench of the invention as operatively engaged with a male contact pin of an elbow-type loadbreak connector, a portion of the pin being broken away for clarity.
Figure 5:
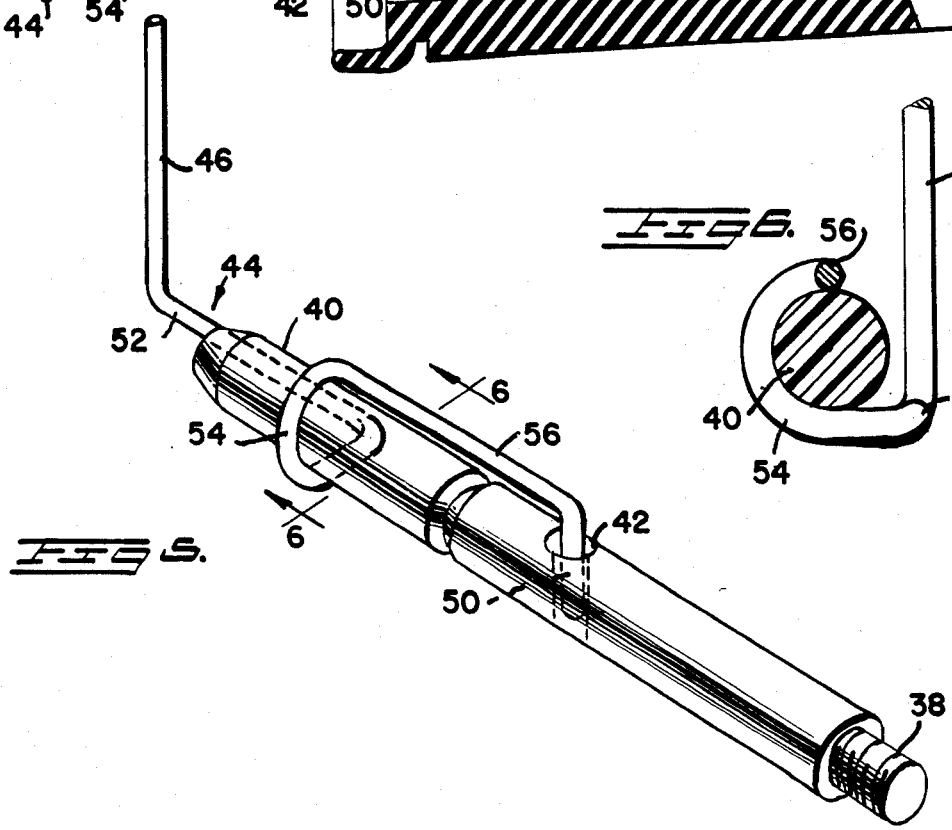
FIG. 5 is a perspective view of a male contact pin having a wrench according to the invention operatively interconnected therewith.
Figure 6:
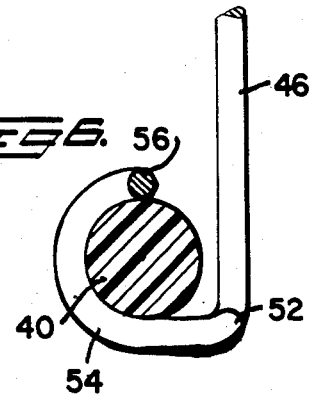
FIG. 6 is a fragmentary sectional view taken on line 6—6 of FIG. 5.

As shown in the drawings, a diametrical hole 42 is provided in male contact pin 36. This hole is adapted for interengagement with a portion of a handling tool to facilitate placement, maneuvering and tightening of the pin with respect to the conductor contact 32. Heretofore in this application, mention has been made of two known devices or tools to facilitate operative insertion and engagement of male contact pin into arm 20 of the loadbreak connector. The wrench of the present invention, per se, is shown in perspective in FIG. 2. It is formed of a wire or rod-like material of sufficient dimensions and strengh to fulfill its purpose as a wrench in operation. The wire is heated and can then be bent to the desired configuration. The wrench or tool is generally indicated at 44 and after being bent, includes a handle portion 46, a median portion 48 and a male contacting pin hole 42 engaging end 50. The median portion 48, from handle portion 46, includes a straight portion or segment 52 and a subsequent portion 54 is bent by appropriate machinery or mechanism to make a loop, FIG. 2, which in effect constitutes a curvilinear shaped recess or set back at the end of portion 52. A straight portion or segment 56 extends from the curvilinear recess or set back 54 and the extremity thereof is then bent to form the hole engaging bent end 50. Attention is invited to the construction wherein the segment 56, while generally parallel to the section 52, is set back a slight distance as can be seen from FIGS. 5 and 6. This is due to the curvilinear recess configuration.

The curved or curvilinear portion has a mouth 58 of a width such that, when operably engaged with tip 40, has a snap-on frictional engagement therewith due to the resiliency in the wire constituting the wrench and also the material constituting the tip 40.

In use, the end 50 is inserted in hole 42 and the curvilinear portion or recess 54 is snapped into engagement with and about tip portion 40. End 50 and curvilinear portion 54 then, in an interrelated action, securely fasten the wrench to the male contact pin. The frictional fit or engagement of the tip 40 in the curvilinear portion 54, in conjunction with the end 50 being engaged in hole 42, insure that the male contact pin is securely positioned and held in the wrench or tool 44. As so held, the combination can be manipulated as shown in FIG. 4. The pin 36 as mounted or fastened to wrench 44, shown in full lines, is inserted into the interior of arm 20, and due to the rigidity of the interconnection, the pin can be guided and moved from the position shown in full lines to the position shown in broken lines, indicated at 60 of the wrench and **60*a* of the contact pin. In this position, the threads 38 on the pin are interengaged within the threads of the conductor contact at 34. The rigidity of the interconnection permits a rotation of the pin by the wrench through manipulation of handle 46**, and screw threaded engagement is possible with a tightening action to insure mechanical and electrical sustained interconnection therebetween.

It is, accordingly, seen that the present tool or wrench permits a facile and easily maneuverable insertion and fastening of the male contact pin with respect to the conductor contact. By the same token, the male contact pin can be removed from the elbow loadbreak connector by a reversal of this action.

It also will be obvious that the tool or wrench of the present device can be constituted by a relatively simple manufacturing process and of an inexpensive material and nature. The drawings disclose the concept of the snap-on design of the wrench which permits ease of attachment to the contact pin and when so attached, the wrench and pin are maintained in a fixed position, greatly simplifying the task of aligning and turning the pin for placement, removal and replacement. The device being inexpensive is susceptible of being produced as a throw-away item and as such can constitute a part of a kit including the loadbreak elbow connector construction, the contactor pin and wrench, i.e., all components necessary for the elbow connection.

Accordingly, it will be seen that the present invention overcomes problems existing with prior structures and constitutes a substantial forward moving contribution to the art.

While a specific device and construction has been wn in the drawings, minor variations therein will be ious to those skilled in the art without departing n the spirit of the invention. Such obvious changes nodifications are considered to be within the scope the inventive concept as expressed herein, and as med hereinafter.

What is claimed is:

1. In combination, a longitudinally extended cylindri- pin and a wrench adapted for connective mounting supporting, handling, maneuvering and rotating the said pin having a diametrical wrench engageable e therethrough, said wrench including a frictionally ageable and operable curvilinear pin engaging re- sed portion intermediate the ends of said wrench, l wrench having an end operating handling portion, a pin hole engaging end disposed at an angle to the of said wrench the wrench, when frictionally en- ed to and supporting the pin, with the hole opera- ly interengaged by said pin hole engaging end, being rable for positionally, maneuverably and rotatably ving the pin.

. A cylindrical pin wrench for operative connection nd mounting and supporting, for handling, maneu- ing and rotating a threaded end pin of a type having iametric wrench engageable hole therethrough, the nch being operable, when attached to the pin, for adedly engaging and tightening the threaded end of h a pin in a coactive member having a threaded pin nection hole therein, said wrench having a pin sup- ting and attaching median section constituted by a vilinear recess offset from the axis of said pin pted for frictionally engaging a peripheral surface tion of said pin, an end operating handle portion on l wrench, disposed at an angle to the axis of said lian portion, and a pin connection hole engaging end osed at an angle to the median section axis, the nch, when operatively engaged to the pin, with the necting hole operatively interengaged by the pin e engaging end portion being positionally maneuver- and rotatable by said handle portion to operatively age and secure the pin and the coactive member, or ngage the pin from the said member.

. A longitudinally extended and rotatable wrench assembling and disassembling a male contact pin and onductor contact in an electric cable distribution em, wherein the male contact pin and conductor tact have respectively enterengageable screw ads, and the male contact has a wrench engaging hole therein, said wrench including a median, longitudinally offset, recessed pin engaging and attachment portion for receiving and holding said pin in frictional engagement therewith, an end portion of said wrench being operatively insertable in said wrench engaging hole to positionally interengage and fix the wrench and pin and permitting concurrent rotation thereof for selective interconnection of the said screw threads.

4. A wrench as claimed in claim 3, said contact pin being cylindrical, said wrench and recessed wrench portion being constructed of resilient material and said recessed portion being of curvilinear configuration, and said recessed portion having a longitudinal opening of a smaller dimension than the diameter of said pin and adapted to receive said pin in resilient snap-on engagement therewith.

5. A wrench as claimed in claim 4, said hole insertable wrench end portion constituting a first end of said wrench, bent at an angle perpendicular to the longitudinal axis of the wrench.

6. A wrench as claimed in claim 5, wherein a second end of said wrench is bent at an angle to the longitudinal axis of the wrench and constitutes a handle for operatively rotating said wrench and a contact pin fixedly engaged thereto.

7. A wrench as claimed in claim 6, said first and second wrench ends being disposed in opposite directions to facilitate connections with and rotation of said contact pin.

8. A wrench as claimed in claim 7 wherein the body of said wrench consists of relatively stiff but slightly resilient wire, the wrench being bent to constitute the various portions thereof.

9. A wrench as claimed in claim 8, wherein said male contact pin and said conductor respectively contact constitute elements of a loadbreak connector elbow disposed interiorly of arms of said elbow, the arms being at right angles to one another.

10. A wrench as claimed in claim 3, wherein said male contact pin and said conductor contact constitute elements of a loadbreak connector elbow disposed respectively interiorly of arms of said elbow, the arms being at right angles to one another.

11. A wrench as claimed in claim 9, said contact pin constituting a URD elbow terminator pin, said wrench consituting a tool for insertion and removal of said pin in and from said elbow.

* * * * *